United States Patent [19]

Carey

[11] Patent Number: 4,945,589

[45] Date of Patent: Aug. 7, 1990

[54] COMBINATION SEAT CUSHION AND CARRYING BAG

[76] Inventor: Arthur R. Carey, Box 311, Farmington, Del. 19942

[21] Appl. No.: 454,370

[22] Filed: Dec. 21, 1989

[51] Int. Cl.[5] ..... A47G 9/00

[52] U.S. Cl. ..... 5/442; 5/436

[58] Field of Search ..... 5/417, 420, 437, 441, 5/442, 462, 485, 490; 190/2, 8

[56] References Cited

U.S. PATENT DOCUMENTS

| | | | |
|---|---|---|---|
| 2,293,530 | 8/1942 | Beehler | 5/442 X |
| 2,771,112 | 11/1956 | Ingram . | |
| 3,419,301 | 12/1968 | Smith . | |
| 3,863,283 | 2/1975 | Mohr | 5/442 |
| 3,938,569 | 2/1976 | Hill | 5/442 X |
| 4,096,929 | 6/1978 | Frey et al. | 5/448 X |
| 4,185,673 | 1/1980 | Daniello | 5/442 X |
| 4,654,907 | 4/1987 | Haugaard . | |
| 4,688,286 | 8/1987 | Miker, Jr. | 5/485 |
| 4,799,731 | 1/1989 | Brown . | |
| 4,802,249 | 2/1989 | Bills | 5/420 |
| 4,821,853 | 4/1989 | Young . | |
| 4,843,662 | 7/1989 | Handelman | 5/420 X |

*Primary Examiner*—Michael F. Trettel

*Attorney, Agent, or Firm*—John C. Andrade

[57] ABSTRACT

A combination seat cushion and carrying bag having two opposed padded compartments and a pocket for storing articles in between. The articles are cushioned by the padded compartment when the article is used as a seat cushion.

1 Claim, 3 Drawing Sheets

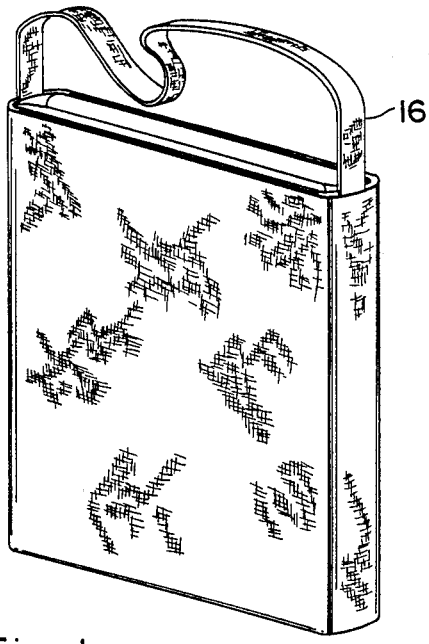
Fig. 1
Fig. 2
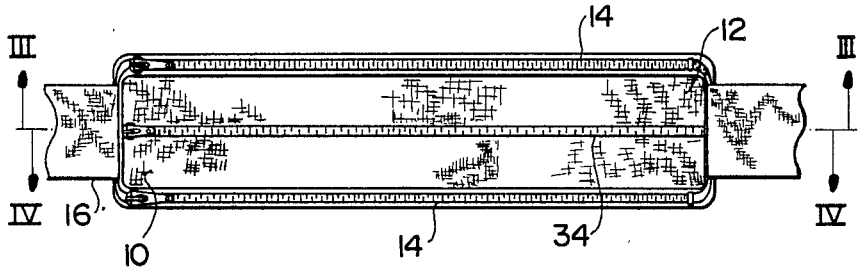

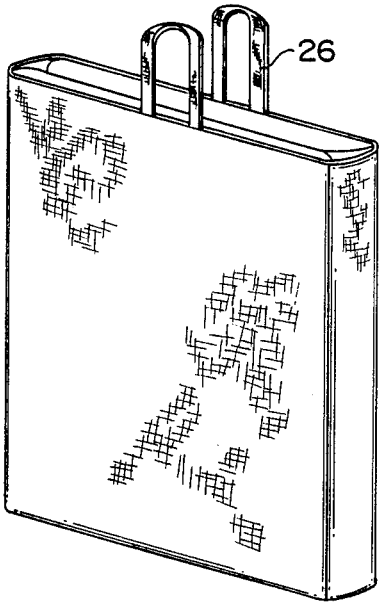
Fig. 5
Fig. 6
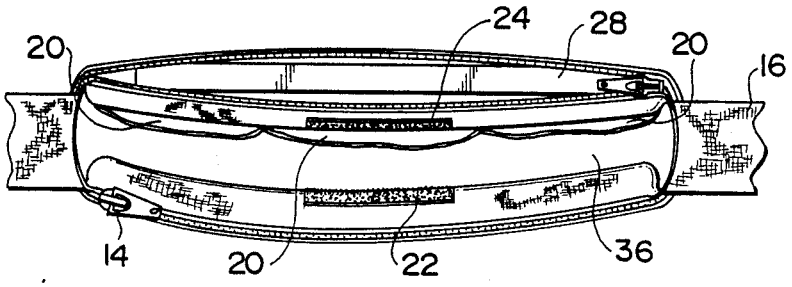

COMBINATION SEAT CUSHION AND CARRYING BAG

BACKGROUND

This invention relates to a portable seat suitable for storing articles. For many outings, entertainment or sporting events, it becomes necessary to sit on seats with hard surfaces for extended periods of time. Sitting on hard seats can be uncomfortable and a portable seat cushion would be useful in reducing the discomfort level due to such seats.

Normally, in addition to having to carry the seat cushion, there are other articles that would need to be carried. Storage space for such articles around the seat can be somewhat limited and it would be useful if the seat cushion and bag for storing such articles could be combined. While storing articles under a seat may at times be an option, there are many types of seats that are solid underneath and no storage is provided for underneath the seat.

U.S. Pat. No. 4,799,731 describes a combination stadium seat cushion that covers a typical stadium seat and provides for storing of articles under said seat. However, said seat cannot be used with a seat that is solid underneath and it is necessary to assemble the seat cushion before using it. It would be desirable to have a seat cushion that could also be used for the storage of articles that could be used as padding for all types of hard seats and would not require assembly and disassembly to use.

SUMMARY OF THE INVENTION

A combination seat cushion and carrying bag that can be used with all types of hard surface seats and which requires no assembly or disassembly has now been discovered. The combination seat cushion and carrying bag includes two opposed padded compartments, each having an exterior and an interior side and a pocket for storing articles. The pocket is positioned between the interior sides of the two opposed padded compartments so that the padded compartments operate to cushion any articles stored in the pocket from the force applied to either of the exterior sides of the padded compartments when the seat cushion is being used as a seat.

The padded compartments can be any shape, e.g. rectangular, hexagonal, triangular, round, etc. and the padding material can be any material that would adequately operate as a cushion, substantially reducing the force applied to the backside of an individual when sitting upon a hard surface. The most common type of material that would be used would be some type of foam rubber. The compartments would preferably have a means for opening and closing said compartments so that the padding material can be easily removed. This would allow for replacement and or cleaning of the padding material and the cleaning of the carrying bag.

The combination bag would preferably have a means for carrying the bag and would most preferably have a handle and a strap. The strap could be detachable and a separate compartment could be provided in the interior or the exterior of the bag for storage of the strap. The pocket for storing articles can further have a plurality of separate compartment within it for separating stored articles. The storage bag would preferably be closable with a hook and loop type fastening system or a zipper. The inner compartments of the storage bag may also be equipped with hook and loop and/or zipper type means for closure.

Another alternative to the padding material would be to use inflatable air cushions in place of the padding material. This would have the advantage of reducing the bulk in carrying the bag but would have the disadvantage of having to be inflated before it could be used.

BRIEF DESCRIPTION OF THE DRAWINGS

FIG. 1 is a perspective view of the exterior of the combination seat cushion/carrying bag.

FIG. 2 is a top view of the combination seat cushion/-carrying bag.

FIG. 5 is a perspective view of the exterior of the combination seat cushion/carrying bag showing handles.

FIG. 6 is a top view of the combination seat cushion/-carrying bag showing the pocket in an open position.

DETAILED DESCRIPTION OF THE DRAWINGS

Figure 3:
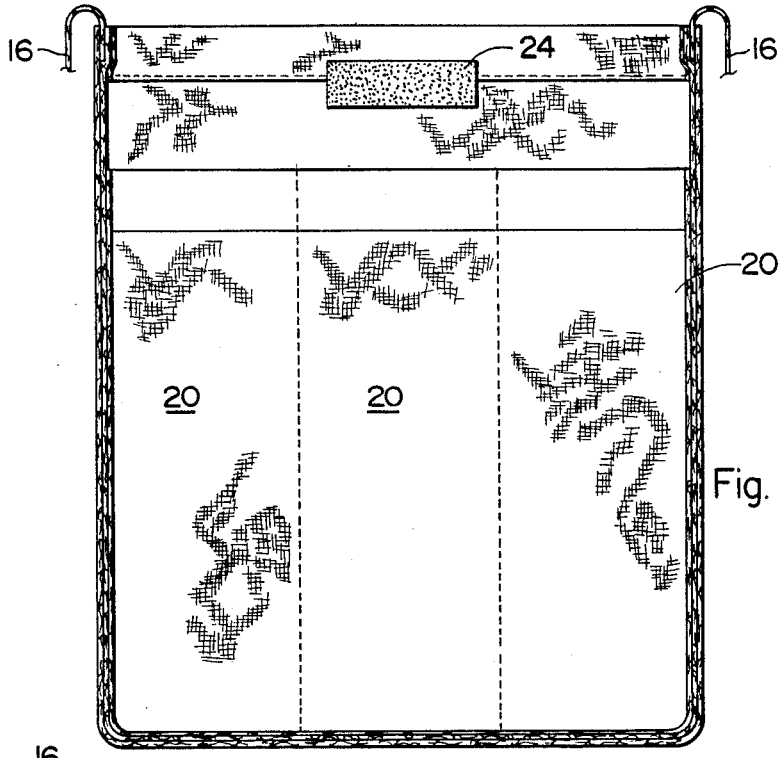
FIG. 3 is a perspective view of the interior side of one of the padded compartments.
Figure 4:
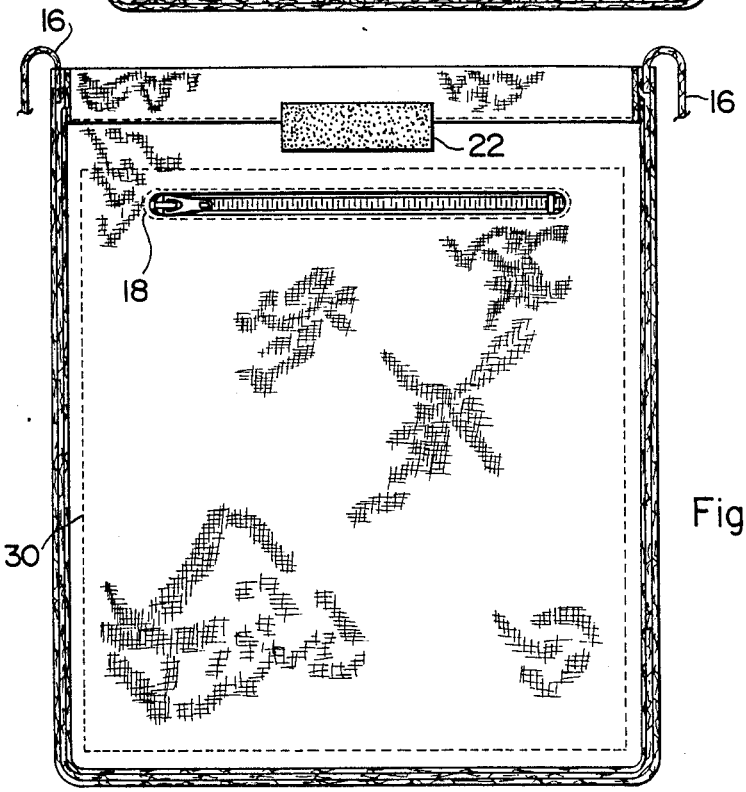
FIG. 4 is a perspective view of the interior side of other padded compartment.

FIGS. 1 and 5 are perspective views of the exterior of the combination seat cushion and carrying bag. FIG. 5 shows one possible method for attaching handles 26 to the carrying bag, whereas FIG. 1 shows the bag with a carrying strap 16. It is expected that the most common embodiments of the invention would include a carrying strap or both handles and a carrying strap. FIGS. 3 and 4 show the interior sides of the two padded compartments. FIG. 3 further shows interior compartments 20 for storing articles in the interior of the carrying bag. The closure system shown in FIGS. 3 and 4 is a hook and loop fastening system commonly referred to as "Velcro" hook and loop fastening system. It consists of opposing pieces of fabric, one with a dense arrangement of tiny hooks, typically nylon and the other with a dense fabric pile, typically nylon, that interlock when pressed together. FIG. 3 shows the dense fabric portion 24 of the hook and loop fastening system. FIG. 4 shows a zippered 18 inner compartment 30 of the carrying bag and further shows the hooks portion 22 of the hook and loop fastening system.

FIGS. 2 and 6 are top views of the combination seat cushion and carrying bag. FIG. 2 shows a zippered closure 34 for the pocket 36. It further shows zippers 14 for the padded compartments 10 and 12. FIG. 6 shows the pocket in an open position showing the interior 36 of the pocket. The fastening system shown on FIG. 6 is a hook 22 and loop 24 fastening system. One of the padded compartments is shown with the zipper portion unzipped and the foam rubber padding 28 shown.

I claim:

1. A combination seat cushion and carrying bag comprising: two opposed padded compartments each having an exterior and an interior side, each of said two compartments having a padding material insert inside of said compartments, said carrying bag having a pocket for storing articles, said pocket positioned between the interior sides of said two opposed padded compartments, such that said padded compartments operate to cushion any articles stored in said pocket from the force applied to either exterior side of said padded compartments, said force occurring when said bag is used as a seat cushion, means for closing said pocket at the top of said pocket, an opening at the top of each padded compartment for removing the padded material inserts from each compartment, a means for closing said opening at the top of each padded compartment and a means for conveniently carrying said bag.

* * * * *